US009746289B2

(12) United States Patent
Hahn et al.

(10) Patent No.: US 9,746,289 B2
(45) Date of Patent: Aug. 29, 2017

(54) INTERNALLY REINFORCED ROLLING DOOR SLAT

(71) Applicant: LAWRENCE ROLL UP DOORS, INC., Baldwin Park, CA (US)

(72) Inventors: Steven Hahn, Brentwood, CA (US); Paul Freberg, La Canada, CA (US); Paul Lawrence, Monrovia, CA (US)

(73) Assignee: LAWRENCE ROLL UP DOORS, INC., Baldwin Park, CA (US)

( * ) Notice: Subject to any disclaimer, the term of this patent is extended or adjusted under 35 U.S.C. 154(b) by 0 days.

(21) Appl. No.: 14/615,324

(22) Filed: Feb. 5, 2015

(65) Prior Publication Data

US 2016/0230444 A1 Aug. 11, 2016

(51) Int. Cl.

| | |
|---|---|
| ***E06B 9/15*** | (2006.01) |
| ***F41H 5/24*** | (2006.01) |
| ***F41H 5/04*** | (2006.01) |
| ***F41H 5/06*** | (2006.01) |
| ***F42D 5/045*** | (2006.01) |

(52) U.S. Cl.

CPC ..... *F41H 5/24* (2013.01); *F41H 5/045* (2013.01); *F41H 5/0442* (2013.01); *F41H 5/0457* (2013.01); *F41H 5/06* (2013.01); *F42D 5/045* (2013.01); *E06B 2009/1516* (2013.01)

(58) Field of Classification Search

CPC ..... E06B 2009/1516
USPC ..... 160/232, 235, 236, 133, 201; 49/92.1
See application file for complete search history.

(56) References Cited

U.S. PATENT DOCUMENTS 880,701 A * 3/1908 Vance ..... E06B 3/485 160/232
2,951,533 A * 9/1960 Lucas ..... E06B 3/485 160/201
4,173,247 A * 11/1979 Piana ..... E06B 9/165 160/220
4,343,340 A * 8/1982 Paule ..... E06B 9/165 160/232
4,382,460 A * 5/1983 Ben-Tal ..... E06B 7/084 160/236
4,432,591 A * 2/1984 Rinkewich ..... E06B 9/15 160/232
4,470,444 A * 9/1984 Riexinger ..... E06B 9/15 160/232
4,601,953 A * 7/1986 Haffer ..... E06B 9/165 160/133
4,628,982 A * 12/1986 Labelle ..... E06B 9/15 160/232
4,630,664 A * 12/1986 Magro ..... E06B 9/15 160/232
4,644,724 A * 2/1987 Schijf ..... E04F 13/0889 160/235

(Continued)

*Primary Examiner* — David Purol
(74) *Attorney, Agent, or Firm* — Perkins Coie LLP

(57) ABSTRACT

A rolling door slat designed to deflect, redirect or absorb severe force is disclosed. The present invention utilizes a double slat design with layered joints, and an open volume enclosing a reinforced core. The reinforced core of the present invention consists of either a solid block of dense, protective material, or layers of material. The layers of material serve to both deflect and absorb impact and blast force, resist vertical force, as well as provide more traditional rolling door functions such as fire resistance or sound and heat insulation.

10 Claims, 11 Drawing Sheets

(56) References Cited

U.S. PATENT DOCUMENTS

| | | | | | |
|---|---|---|---|---|---|
| 4,690,193 | A * | 9/1987 | Morrison | E06B 9/165 | 160/133 |
| 4,979,553 | A * | 12/1990 | Lowry, III | E06B 3/485 | 160/133 |
| 5,070,925 | A * | 12/1991 | Paule | E06B 9/17061 | 160/133 |
| 5,365,990 | A * | 11/1994 | Ueda | E06B 9/15 | 160/133 |
| 5,419,386 | A * | 5/1995 | Magro | E06B 9/15 | 160/232 |
| 5,718,276 | A * | 2/1998 | Rekret | E05D 15/242 | 160/201 |
| 5,839,493 | A * | 11/1998 | Quasius | E06B 9/165 | 160/133 |
| 5,941,021 | A * | 8/1999 | Valls, Jr. | E06B 7/086 | 160/236 |
| 7,328,613 | B2 * | 2/2008 | Volkel | E06B 9/15 | 160/232 |
| 2007/0101651 | A1 * | 5/2007 | Nien | E06B 7/084 | 49/92.1 |
| 2007/0137802 | A1 * | 6/2007 | Lukasik | E06B 9/15 | 160/235 |

* cited by examiner

INTERNALLY REINFORCED ROLLING DOOR SLAT

FIELD OF THE INVENTION

The present invention relates to the field of rolling doors. The present invention more particularly relates to rolling doors which are resistant to high force such as gunfire.

BACKGROUND OF THE INVENTION

Rolling doors or industrial doors are typically used to cover a building opening to prevent the passage of objects, vehicles, people, elements, sound, or heat through the opening. Rolling doors are formed, in general, of a series of horizontally elongated, narrow, slats which are pivotally connected together along their adjacent horizontal edges. Thus, the slats may be rolled up around a suitable hub or axle or, alternatively, rolled down to form an articulated curtain. Such doors are normally mounted on a window opening or a door opening. Thus, the doors are either rolled up above the opening, out of the way, or extended downwardly into the curtain formation to cover the opening.

Common uses for such rolling doors usually include providing a seal for an opening of varying shapes that can easily be held open without requiring swing space for a door. Modified versions of rolling doors have previously been configured towards providing insulation for heat or sound. The slats for such rolling doors are modified with internal materials suited for accomplishing these goals such that the size or profile of the individual slats is not noticeably increased.

Other modified versions of the rolling door have been used as window shutters in high wind storm areas; shutters are commonly used to protect window and door openings against wind hurled debris. In such storm areas, the shutters normally are kept rolled up out of the way until needed for protection.

In the past, roll-up type shutters formed of pivotally connected slats have been able to resist a limited amount of force without being penetrated. In recent years, because of severe building damages due to hurricane type storms, Such force resistant shutters provide some limited protection of windows. Accordingly, there is still a need to provide protection from greater impact forces of those which are intentionally caused by malicious actors, such as bullet strikes. The present invention provides a solution to this and other problems, and offers other advantages over the prior art.

INCORPORATION BY REFERENCE

U.S. Pat. No. 5,515,902 entitled, "Reinforced Shutter panel" and U.S. Pat. No. 4,630,664 entitled, "Insulated Roll-Up Door" are incorporated by reference in their entirety and for all purposes to the same extent as if the patents were reprinted here.

BRIEF SUMMARY OF INVENTION

A first aspect of the present invention to provide a rolling door comprising: a plurality of slats, each slat affixed to adjoining slats through a plurality of joints thereby forming a rolling door curtain and each slat having an internal volume; the internal volume predominantly filled with at least one reinforcement bar and at least one core material; the reinforcement bar configured to provide at least impact force resistance; and the core material configured to provide one or more of the following: force absorption, fire resistance, sound insulation, heat insulation.

An object of the present invention is to provide for a rolling door which is internally reinforced such that the door is resistant to both malicious and natural attempts at puncturing or bypassing the door. It is an additional object of the present invention to provide functions commonly associated with existing rolling doors simultaneously with newly invented functions.

Variations upon the present invention include differing configurations of reinforcement bars and core materials utilized in the internal volume of each rolling door slat. These variations provide differing levels of protection from different types of malicious or natural strikes. Reinforcement bar materials may vary considering the factors of weight, cost, and strength. Desired materials for the core material may vary based on desired functions, and cost.

BRIEF DESCRIPTION OF THE DRAWINGS

The subject invention will be more fully understood and appreciated from the following detailed description, taken in conjunction with the drawings in which.

DETAILED DESCRIPTION

It is to be understood that this invention is not limited to particular aspects of the present invention described, and as such may, of course, vary. It is also to be understood that the terminology used herein is for the purpose of describing particular aspects only, and is not intended to be limiting, since the scope of the present invention will be limited only by the appended claims.

Unless expressly defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described. For purpose of this disclosure, the term "impact force" refers to force delivered at a point or narrow section of a given surface area. For purposes of this disclosure, the term "blast force" refers to force delivered reasonably uniformly over a wide area or notable percentage of a given surface area. For purposes of this disclosure, the term "fire resistance" includes, but is not limited to either or both of the fire ratings for fire resistance or fire protection.

Figure 1:
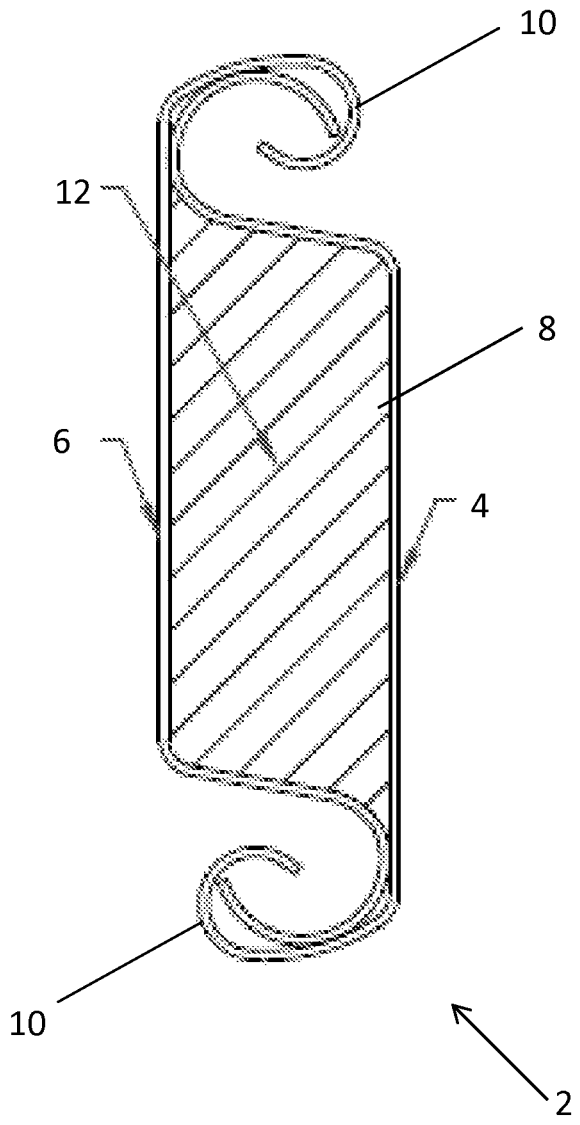
FIG. 1 is a cross section of a first embodiment of the presently invented rolling door double slat.

Referring now to FIG. 1, a cross section of a first embodiment of the presently invented rolling door double slat 2. The invented double slat is constructed using two identical roll-formed slats—a front slat 4 and a back slat 6. The two identical slats 4 and 6 fit together when one has the reverse orientation of the other. When joined, the front and back slat 4, 6 form a central compartment 8, and an upper and lower joint curl 10. Between the two fitted slats 4, 6, is a reinforced core material 12. The front and back slat 4, 6 are built using steel, stainless steel, or another suitable formable metal. The reinforced core 12 material varies in construction based upon the embodiment of the double slat 2 used. This construction will be discussed further in the paragraphs that follow. When assembled, the invented double slat 2 would measure $7/8^{th}$ an inch thick, 2½ inches tall, and cut in length to customer requirements. These measurements are meant to merely be illustrative rather than limiting. Other measurements would also be suitable.

Figure 2:
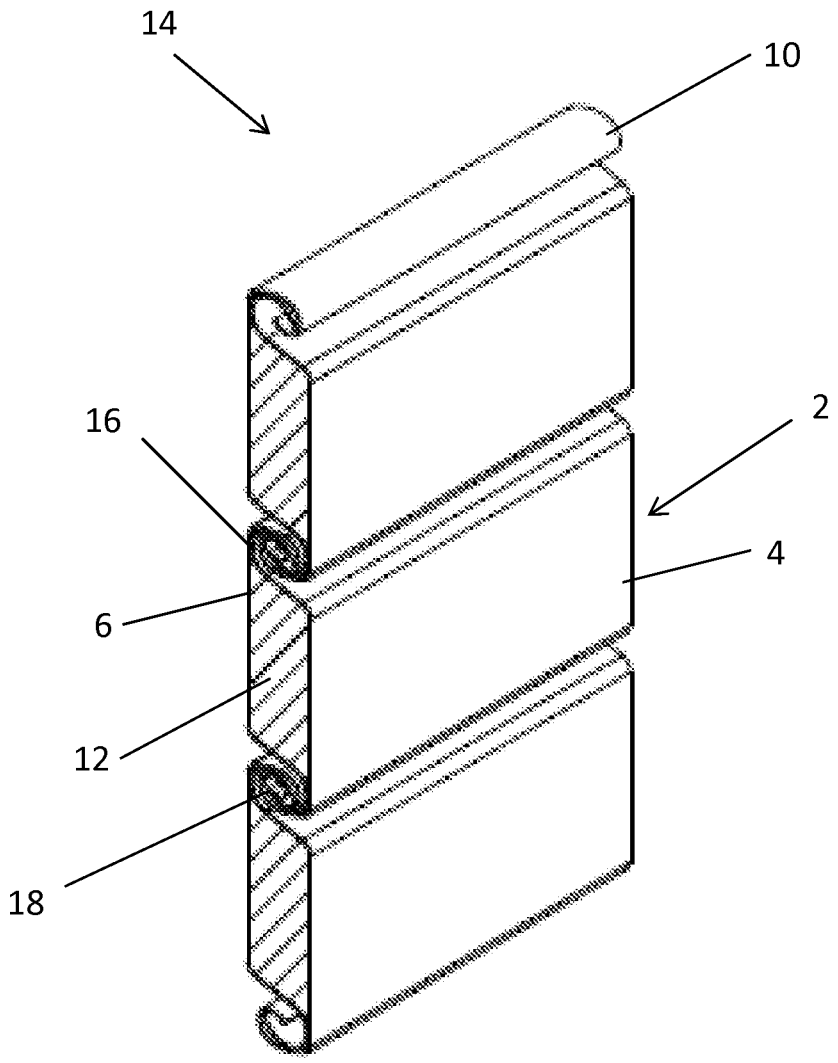
FIG. 2 is a perspective view of multiple invented double slats affixed together to form a door.

Referring to FIG. 2, a perspective view of multiple invented double slats 2 affixed together to form a door 14. With multiple double slats 2, joint curls 10 are slid together to form a joint 16. The joint 16 allows the door 14 to articulate and roll up or hang straight. At each joint 16, a steel rod 18 can be inserted to improve the durability of the joint 16. At each joint 16, six layers of slat 4, 6 and a steel rod 18 align from the front of the door 14 to the back. The stacked layers of the joint 16 when subjected to a great deal of force, impact, blast, or ballistic strike will either repel the force, or crumple thereby locking the joint 16 in place.

The door 14 is not limited to a traditional rolling door that rolls up to open, but could also apply to an inverted door 14 where the door rolls down to open or to a door in a horizontal position that would roll to the side to open. Additionally, in some of the configurations, especially those spanning large doorways, as a result of the increased weight from particularly dense reinforced cores 12, the rolling door 14 would utilize a more powerful motor than that of a standard rolling door and would include additional support measures to affix the rolling door to the entryway space. Such additional support would include additional or larger bolts.

Figure 3:
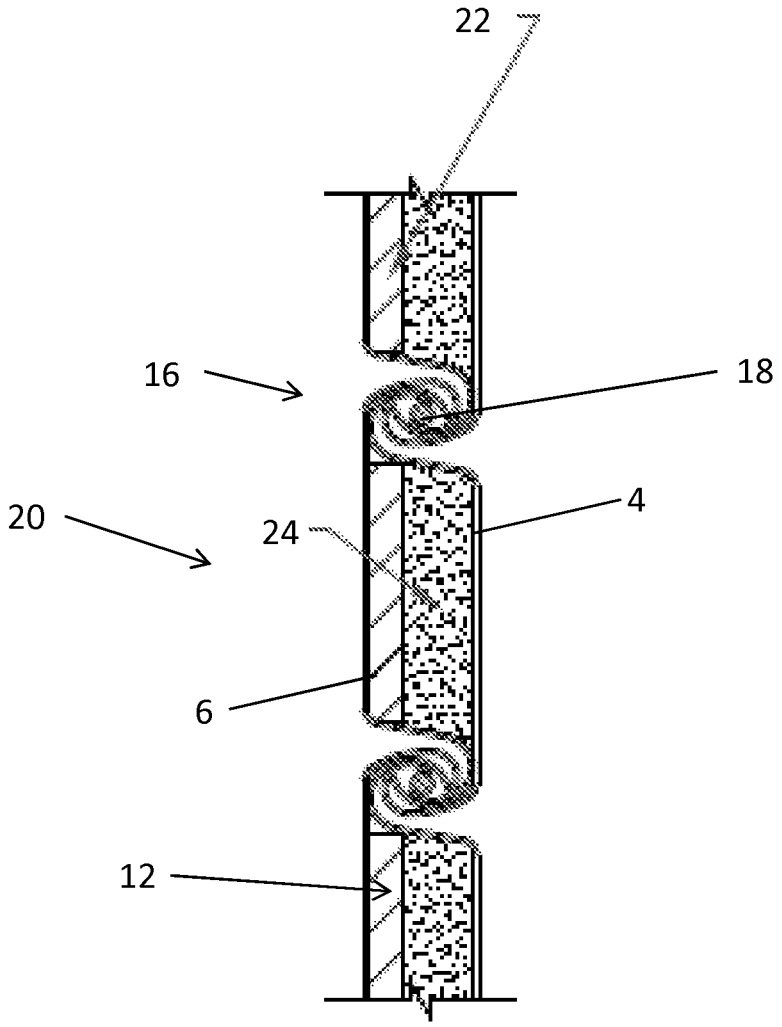
FIG. 3 is a cross section of a second embodiment of the presently invented rolling door double slat.

Referring to FIG. 3, a cross section of a second embodiment 20 of the presently invented rolling door double slat. The second embodiment 20 utilizes a reinforcement core 12 with a reinforcement bar 22 and a core material 24. The reinforcement core 12 of the second embodiment 20 is configurable such that the reinforcement bar 22 is positioned at either the front or the rear of the double slat 20. The positioning of the reinforcement bar 22 would depend on the desired properties of the second embodiment 20. Such properties would include deflecting impacts or absorbing impacts. Placing the reinforcement bar 22 behind the front slat 4 would improve the ability of the second embodiment 20 to deflect impact force. Placing the reinforcement bar 22 in front of the rear slat 6 would improve the ability for the core material to absorb the force of the impact, and finally stop the mitigated impact at the reinforcement bar 22 if necessary. The core material 24 could additionally be configured to have a secondary function such as fire resistance or heat/sound insulation.

The materials used for the reinforcement bar 22 and the core material 24 would vary depending on function and cost. The reinforcement bar 22 would be constructed of steel, hardened steel, lead, titanium, ballistic ceramic plates, or similarly bullet resistant materials known in the art. The core material 24 would be made of Kevlar, wood, expanded polystyrene, polyurethane, mineral wool, solid acrylic, or other suitable materials that would improve the properties of density, impact or blast absorption, deformation resistance, fire resistance, sound insulation, or heat insulation. An example material configuration of the second embodiment of the double-slat 20, would include a hardened steel reinforcement bar 22 positioned in front of the rear slat 6 and a Kevlar core material 24 positioned behind the front slat 4. This example is merely intended to be illustrative, as any combination of the above reinforcement bar 22 and core material 24 materials would be an acceptable configuration of the present invention.

Figure 4:
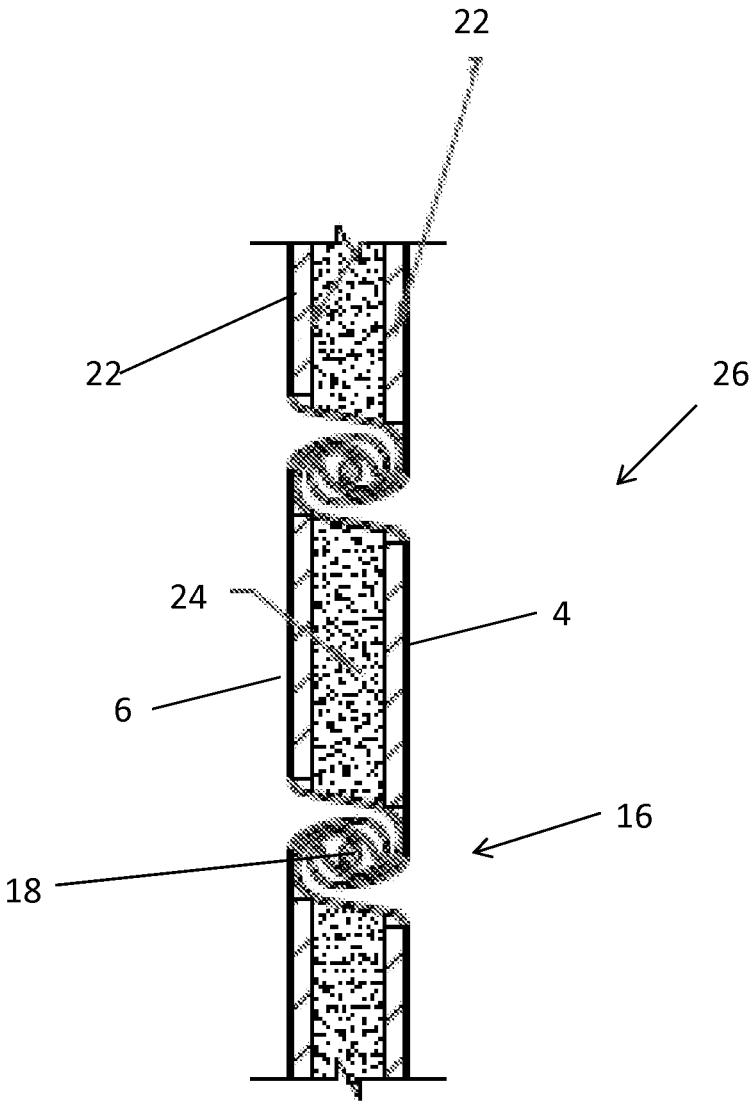
FIG. 4 is a cross section of a third embodiment of the presently invented rolling door double slat.

Referring to FIG. 4, a cross section of a third embodiment 26 of the presently invented rolling door double slat. The third embodiment 26 includes two reinforcement bars 22 sandwiching core material 24. The third embodiment 26 is designed such that reinforcement bars 22 deflect impacts and provide structural strength for the shape of the double slat 2. The additional structural support provides "vertical force resistance." "Vertical force resistance" is defined in the scope of this disclosure as a type of force resistance that refers to the tendency of the double slat to resist being deformed or crushed. Such force would generally be applied mechanically as with a crowbar or other tool which amplifies mechanical force of a malicious actor.

Figure 5:
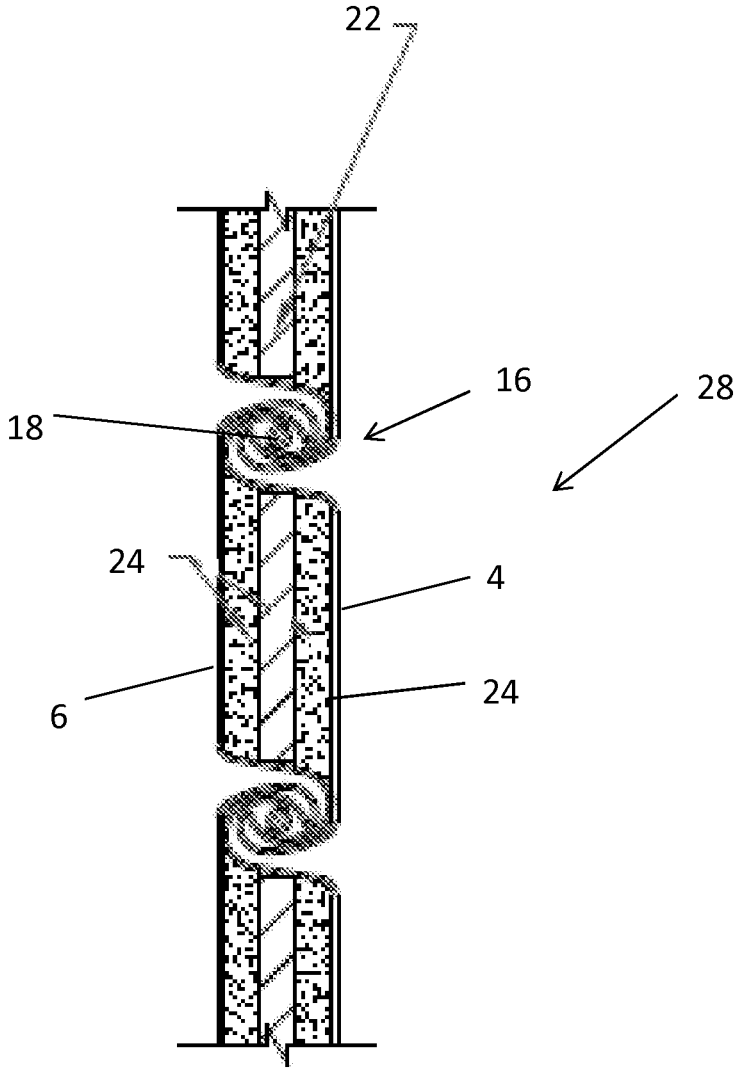
FIG. 5 is a cross section of a fourth embodiment of the presently invented rolling door double slat.

Referring to FIG. 5, a cross section of a fourth embodiment 28 of the presently invented rolling door double slat. The fourth embodiment 28 includes two core materials 24 sandwiching a single reinforcement bar 22. The fourth embodiment 28 is designed to provide multiple core material functions. As an example, one of the core materials 24 could optionally be configured to absorb force while the second core material 24 could optionally be configured to insulate sound. Alternatively, multiple core materials 24 could be utilized for enhancing a single function such as force absorption. As another illustrative example, the core material 24 positioned adjacent to the front slat 4 could be Kevlar, designed to stop the force of an impact, and the core material 24 adjacent to the back slat 6 and positioned behind the reinforcement bar 22 would be a material having high elasticity such that the material provided shock absorption for the reinforcement bar 22.

Figure 6:
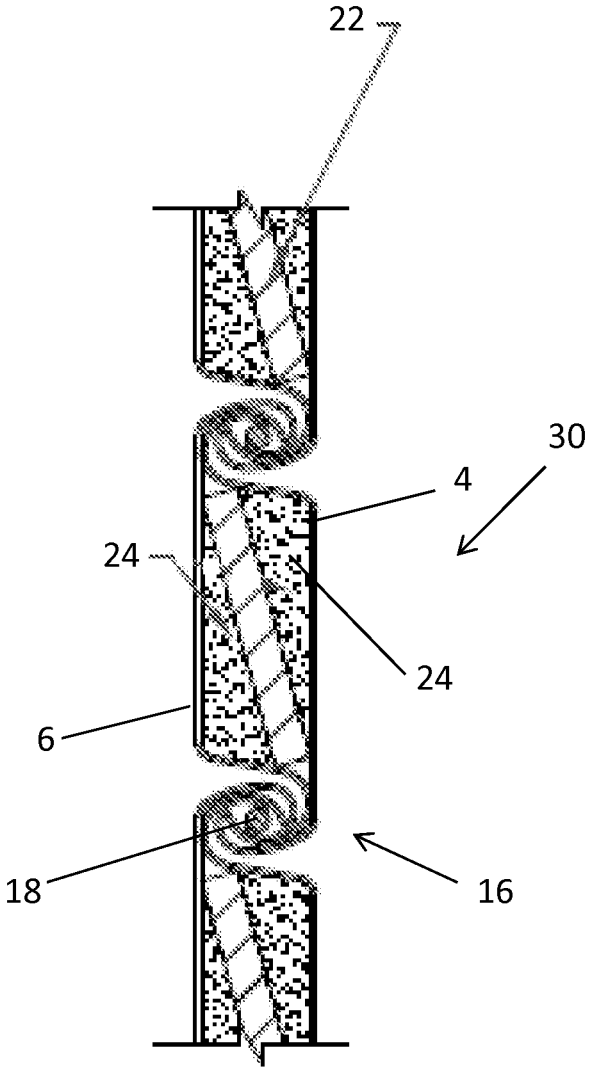
FIG. 6 is a cross section of a fifth embodiment of the presently invented rolling door double slat.

Referring to FIG. 6, a cross section of a fifth embodiment 30 of the presently invented rolling door double slat. The fifth embodiment 30 is designed with a diagonally positioned reinforcement bar 22. Such a configuration of the reinforcement bar 22 is intended to redirect impact force upwards. The reinforcement bar 22 could similarly be positioned diagonally in the opposing direction such that impacts would be redirected down. In addition to redirecting impacts in a perpendicular direction of protected articles behind the invented rolling door, redirecting the impact vertically makes use of the larger vertical dimension of the door as compared with the narrower depth of the door. The additional material provides additional stopping power. Further, the fifth embodiment 30 includes two core materials 24 much like the fourth embodiment 28 of FIG. 5 thereby providing similar functionality.

Figure 7:
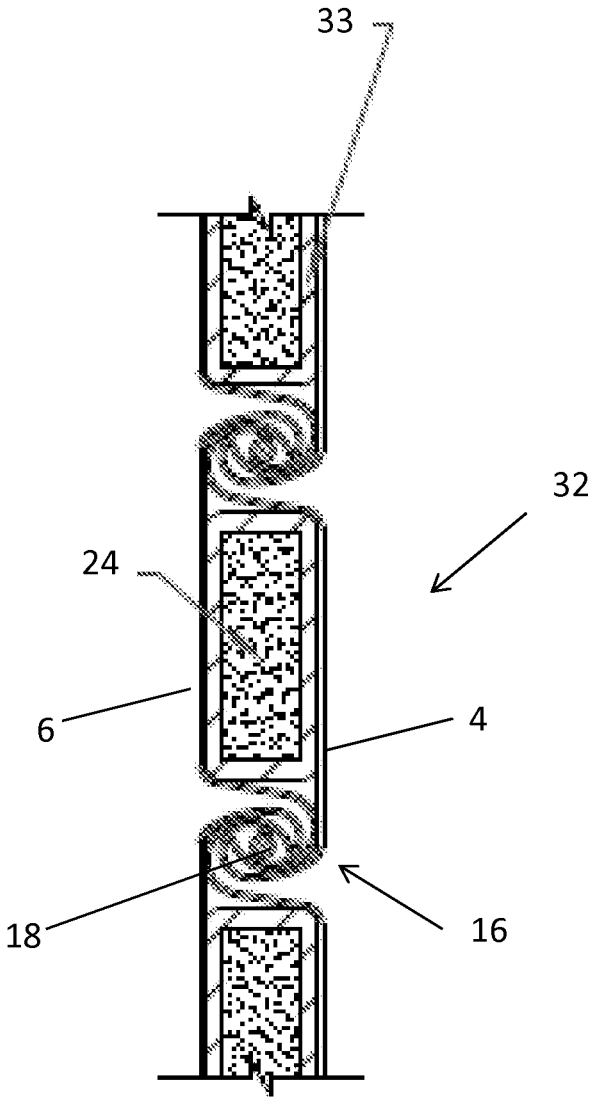
FIG. 7 is a cross section of a sixth embodiment of the presently invented rolling door double slat.

Referring to FIG. 7, a cross section of a sixth embodiment 32 of the presently invented rolling door double slat. The sixth embodiment 32 of the present invention includes a tubular reinforcement bar 33 surrounding core material 24. Using a tubular reinforcement bar 33 provides additional structural strength braced against the front and back slat 4, 6. Such a configuration provides for improved resistance against blast force in addition to impact force, while the core material 24 provides additional support or additional functionality. A tubular reinforcement bar 33 additionally provides vertical force resistance.

Figure 8:
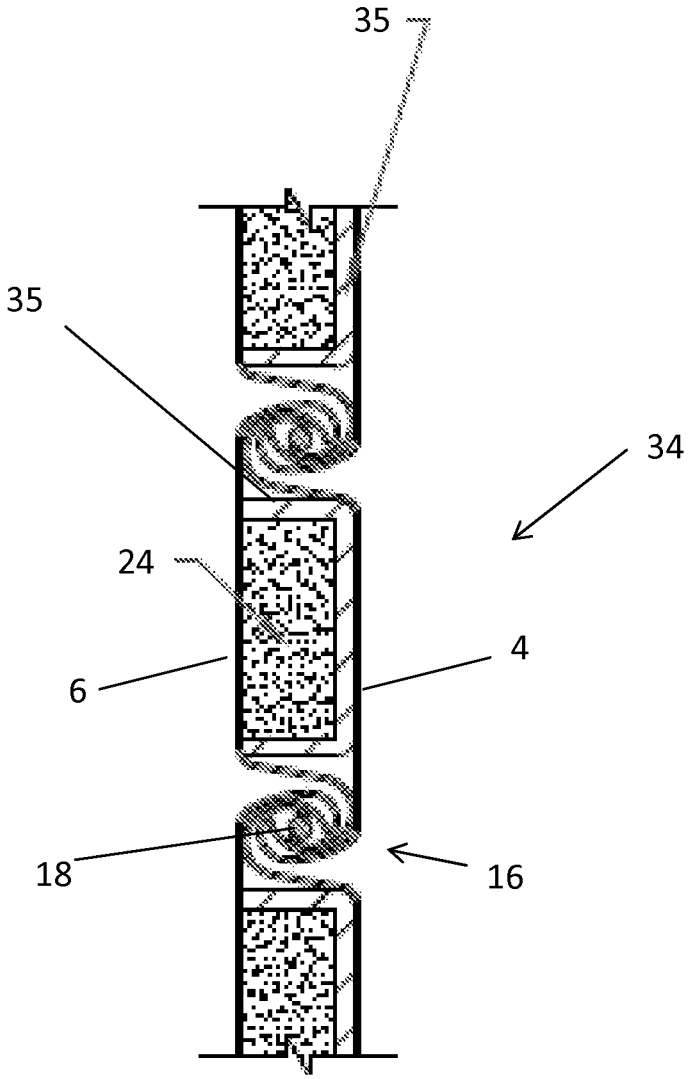
FIG. 8 is a cross section of a seventh embodiment of the presently invented rolling door double slat.

Referring to FIG. 8, a cross section of a seventh embodiment 34 of the presently invented rolling door double slat. The seventh embodiment 34 includes a channel-shaped reinforcement bar 35 which abuts the front slat 4 and is braced against the back slat 6. Similar to the sixth embodiment 32 of FIG. 7, the channel-shaped reinforcement bar 35 is configured to absorb blast force in addition to impact force. A channel-shaped reinforcement bar 35 additionally provides vertical force resistance.

Figure 9:
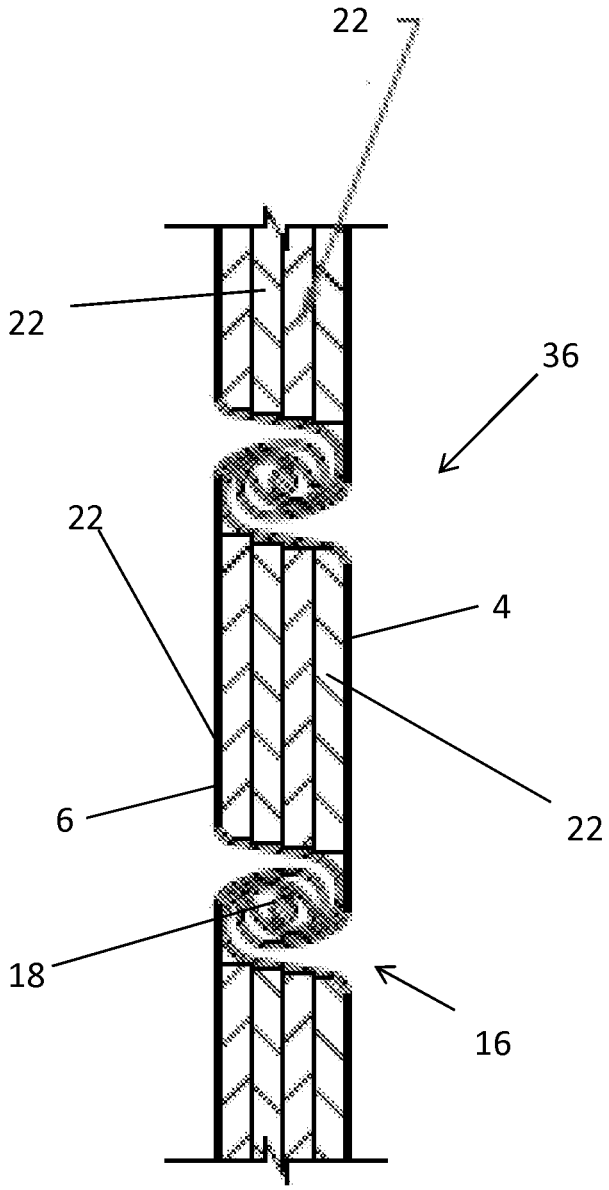
FIG. 9 is a cross section of an eighth embodiment of the presently invented rolling door double slat.

Referring to FIG. 9, a cross section of an eighth embodiment 36 of the presently invented rolling door double slat. The eighth embodiment 36 of the present invention includes multiple layers of reinforcement bars 22. Such a configuration could optionally utilize the same materials for each layer. For example multiple ballistic ceramic plates layered together would withstand multiple ballistic impacts. Alternatively, the multiple layers of reinforcement bars 22 would use a variety of materials each with different properties. Multiple reinforcement bars 22 additionally provide vertical force resistance.

Figure 10:
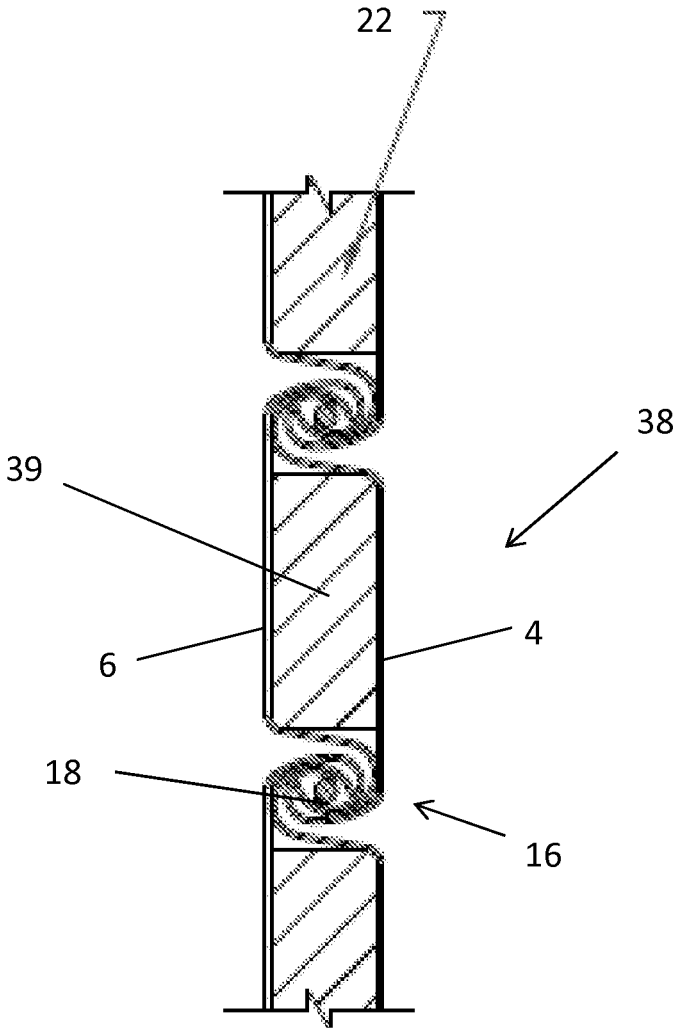
FIG. 10 is a cross section of a ninth embodiment of the presently invented rolling door double slat.

Referring to FIG. 10, a cross section of a ninth embodiment 38 of the presently invented rolling door double slat. The ninth embodiment 38 of the present invention includes a solid reinforced core 39 making use of a single reinforcement bar 22 or a single core material 24 (not pictured) that predominantly fills the entire volume of the double slat 2. A reinforcement bar 22 of this thickness could include a much thicker ballistic plate which would withstand higher caliber and piercing designs of projectiles. Alternatively, as a heavier, but less expensive option, the solid reinforced core 39 consisting of a single reinforcement bar 22 could optionally be composed of a solid block of steel. The ninth embodiment 38 would provide the most protection from impact force but is also the heaviest compared to other embodiments. The ninth embodiment 38 additionally provides vertical force resistance when the solid reinforced core 39 is composed of suitably non-brittle materials such as steel.

Figure 11:
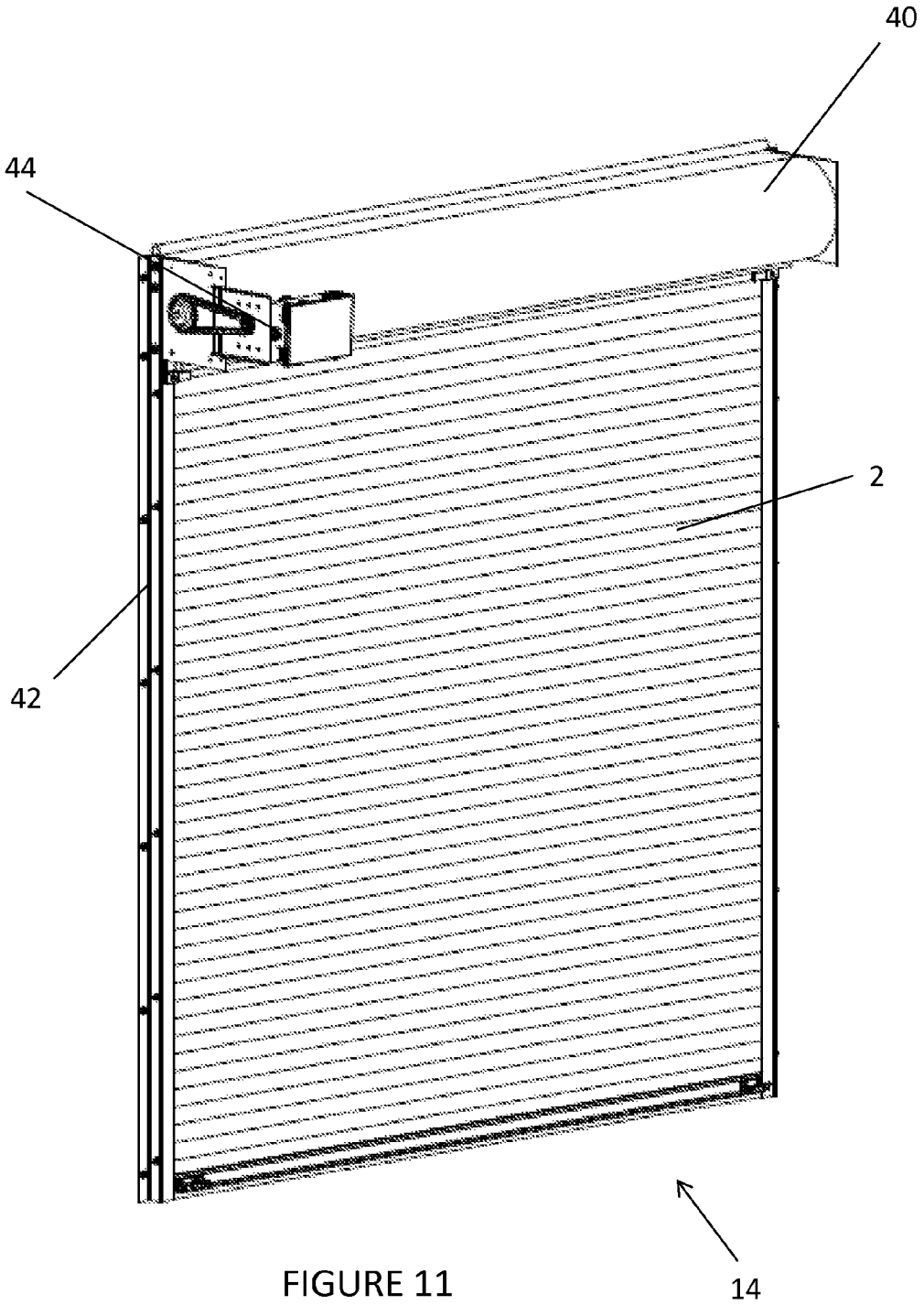
FIG. 11 is a perspective view of an assembled rolling door.

Referring to FIG. 11, a perspective view of an assembled rolling door. A plurality of invented double-slats 2 are affixed together to form a rolling door curtain 14. The rolling door curtain 14 is affixed to a barrel which is covered by a hood 40 and travels in, and is contained by guides 42. The rolling mechanism is powered by a motor 44 or is spring-assisted.

The foregoing disclosures and statements are illustrative only of the present invention, and are not intended to limit or define the scope of the present invention. The above description is intended to be illustrative, and not restrictive. Although the examples given include many specifics, they are intended as illustrative of only certain possible applications of the present invention. The examples given should only be interpreted as illustrations of some of the applications of the present invention, and the full scope of the present invention should be determined by the appended claims and their legal equivalents. Those skilled in the art will appreciate that various adaptations and modifications of the just-described applications can be configured without departing from the scope and spirit of the present invention. Therefore, it is to be understood that the present invention may be practiced other than as specifically described herein. The scope of the present invention as disclosed and claimed should, therefore, be determined with reference to the knowledge of one skilled in the art and in light of the disclosures presented above.

We claim:

1. A rolling door comprising:

a plurality of slats, each slat affixed to adjoining slats through a plurality of joints thereby forming a rolling door curtain and each slat having an internal volume formed by a separation of a front panel and a back panel;

an internal reinforcement contained within each of a plurality of the internal volumes and comprised of one or more pieces of high strength material resistant to deformation and having greater thickness than the front panel and the back panel, the internal reinforcement having a hollow shape with a substantially rectangular cross-sectional profile, and oriented to follow an internal perimeter of each slat such that at least one side of the internal reinforcement is in contact and parallel to the front panel and another side of the internal reinforcement is in contact and parallel to the back panel; and at least one core material contained and surrounded by the internal reinforcement, the at least one core material comprised of a lower strength material than the internal reinforcement.

2. The rolling door of claim 1 wherein the plurality of joints are constructed from overlapping slat layers.

3. The rolling door of claim 2 wherein the plurality of slats are constructed from steel.

4. The rolling door of claim 1 wherein the internal reinforcement is constructed of steel and the core material is constructed of mineral wool.

5. The rolling door of claim 1 wherein the internal reinforcement and the core material in singular or combination additionally provide resistance to blast force.

6. The rolling door of claim 5 wherein the rolling door is configured to resist the blast force from large wind-borne objects.

7. The rolling door of claim 1 wherein the plurality of slats are constructed as double slats such that the internal volume is created by interlocking the edges of two roll-formed slats together.

8. The rolling door of claim 1 wherein the internal reinforcement and the core material in singular or combination are configured to resist ballistic impacts from conventional firearms.

9. The rolling door of claim 1 wherein the internal reinforcement and the core material in singular or combination additionally provide resistance to vertical force.

10. The rolling door of claim 2, wherein each of the plurality of joints further comprises:

a reinforcing rod inserted between the overlapping slat layers.

* * * * *